US008027622B2

(12) United States Patent
Kurimoto et al.

(10) Patent No.: US 8,027,622 B2
(45) Date of Patent: Sep. 27, 2011

(54) TONER REPLENISHING APPARATUS AND IMAGE FORMING APPARATUS

(75) Inventors: Hideaki Kurimoto, Yamatokoriyama (JP); Koichi Mihara, Fujiidera (JP); Toshihide Ohgoshi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 374 days.

(21) Appl. No.: 12/365,478

(22) Filed: Feb. 4, 2009

(65) Prior Publication Data

US 2009/0202276 A1 Aug. 13, 2009

(30) Foreign Application Priority Data

Feb. 13, 2008 (JP) ..... P2008-032421

(51) Int. Cl.
*G03G 15/08* (2006.01)

(52) U.S. Cl. ..... 399/260

(58) Field of Classification Search ..... 399/258, 399/262, 263, 260

See application file for complete search history.

(56) References Cited

U.S. PATENT DOCUMENTS 5,774,772 A 6/1998 Kai et al.
5,943,525 A * 8/1999 Endo et al. ..... 399/27

FOREIGN PATENT DOCUMENTS

JP 62-184471 A 8/1987
JP 09034264 A * 2/1997
JP 09-062081 3/1997
JP 2000-147887 5/2000

OTHER PUBLICATIONS

Masuda (JP 09-034264 A) JPO Machine Translation.*

* cited by examiner

*Primary Examiner* — David Gray
*Assistant Examiner* — Erika J Villaluna
(74) *Attorney, Agent, or Firm* — Nixon & Vanderhye, PC

(57) ABSTRACT

A toner replenishing apparatus capable of, without increasing a drive torque for rotating the toner replenishing container, scraping toner adhered in a toner replenishing container to reduce the quantity of residual toner that remains unfed from the toner replenishing container, is provided. The toner replenishing apparatus includes a toner replenishing container for replenishing toner stored therein to a developing section by rotation of the toner replenishing container, a magnetic body movably provided in the toner replenishing container, and a magnet disposed closely to an outer peripheral surface of the toner replenishing container and attracting the magnetic body with a magnetic force.

11 Claims, 7 Drawing Sheets

TONER REPLENISHING APPARATUS AND IMAGE FORMING APPARATUS

CROSS-REFERENCE TO RELATED APPLICATION

This application claims priority to Japanese Patent Application No. 2008-032421, which was filed on Feb. 13, 2008, the contents of which are incorporated herein by reference in its entirety.

BACKGROUND OF THE INVENTION

1. Field of the Invention

The present invention relates to a toner replenishing apparatus for replenishing toner to a developing section for developing an electrostatic image on a surface of a photoreceptor, and an image forming apparatus including the toner replenishing apparatus.

2. Description of the Related Art

In a toner replenishment method in an image forming apparatus in which an electrostatic image on a surface of a photoreceptor is developed with toner to form an image on a recording medium, a toner replenishing container is firstly filled with toner. Then, the tonner filled in the toner replenishing container is replenished to a toner hopper and is supplied from the toner hopper to the electrostatic image on the surface of the photoreceptor. In the case of such an image forming apparatus, when a user fills the toner replenishing container with toner, sometimes, there is a problem that a user's hand is contaminated because of toner adhered thereto and the like to complicate a toner filling work.

In order to solve such a problem, recently, a method becomes mainstream, that when the toner to be supplied to the electrostatic image on the surface of the photoreceptor becomes insufficient, but it is determined that the toner in the toner replenishing container is exhausted and the toner replenishing container itself is replaced with a new one. In such a toner replenishing container, the toner is aggregated to one another to be solidified due to weight of the toner, resulting that the toner may not be able to be replenished smoothly to the toner hopper.

In order to prevent the toner in such a toner replenishing container from being aggregated to one another, a rotary toner replenishing container is practically in use, in which toner is guided and transported by a spiral projection formed on an inner surface of the toner replenishing container and then replenished to the toner hopper while rotating the toner replenishing container itself. Such a rotary toner replenishing container is able to suppress aggregation of the toner in the toner replenishing container with the simple structure. However, the rotary toner replenishing container has a problem that toner in the toner replenishing container is adhered to an inner wall of the toner replenishing container and remains unfed from the toner replenishing container.

For coping with such a problem, for example, Japanese Unexamined Patent Publication JP-A 2000-147887 discloses a rotary toner replenishing container provided with a spiral scraping member that rotates along an inner wall to scrape toner adhered to the inner wall thereof.

However, in the toner replenishing container disclosed in JP-A 2000-147887, when there remains large quantity of toner in the toner replenishing container, frictional resistance between the spiral scraping member and the toner increases to increase a drive torque for rotating the toner replenishing container, thus posing a problem that wear of a driving component of the toner replenishing container and the scraping member itself is rapidly progressed.

SUMMARY OF THE INVENTION

An object of the invention is to provide a toner replenishing apparatus capable of, without increasing a drive torque for rotating a toner replenishing container, scraping toner adhered in a toner replenishing container to reduce a quantity of residual toner that remains unfed from the toner replenishing container, and an image forming apparatus including the toner replenishing apparatus.

The invention provides a toner replenishing apparatus for replenishing toner to a developing section which develops with toner an electrostatic image on a surface of a photoreceptor drum, comprising:

a toner replenishing container formed into a cylindrical shape, for replenishing toner stored therein, to the developing section by rotation of the toner replenishing container;

a magnetic body movably provided in the toner replenishing container; and a magnet disposed closely to an outer peripheral surface of the toner replenishing container, and attracting the magnetic body with a magnetic force.

According to the invention, there is provided a toner replenishing apparatus, comprising: a toner replenishing container for replenishing toner stored therein to the developing section by rotation of the toner replenishing container; a magnetic body movably provided in the toner replenishing container; and a magnet disposed closely to an outer peripheral surface of the toner replenishing container and attracting the magnetic body with a magnetic force. In the toner replenishing apparatus having such structure, when the toner replenishing container is rotated, the magnetic body in the toner replenishing container is attracted by a magnetic force of the magnet disposed closely to the outer peripheral surface of the toner replenishing container. Accordingly, a frictional force is generated between the magnetic body and an inner wall surface of the toner replenishing container, thus making it possible to scrape toner adhered to the inner wall surface of the toner replenishing container with the magnetic body. As a result, it is possible to reduce a quantity of residual toner that remains unfed from the toner replenishing container.

Furthermore, when there remains large quantity of toner in the toner replenishing container, a force of attraction between the magnetic body mixed in the toner and the magnet is reduced, thus making it possible to prevent frictional resistance between the magnetic body and toner in rotating the toner replenishing container from being increased. As a result, it is possible to prevent a drive torque for rotating the toner replenishing container from being increased and to prevent a driving component of the toner replenishing container from wearing.

Furthermore, in the invention, it is preferable that the magnet is disposed closely to the outer peripheral surface extending by including a lowermost point in a rotary circumferential surface of the outer peripheral surface of the toner replenishing container.

According to the invention, the magnet is disposed closely to the outer peripheral surface extending by including a lowermost point in a rotary circumferential surface of the outer peripheral surface of the toner replenishing container. Accordingly, when a quantity of residual toner remaining in the toner replenishing container becomes small, the magnetic body moves toward a direction of the lowermost point of the toner replenishing container with a weight of the magnetic body and is attracted to the magnet reliably. As a result, when the quantity of residual toner remaining in the toner replenishing container becomes small, the magnetic body attracted by the magnet is able to reliably scrape toner adhered to the inner wall surface of the toner replenishing container.

Furthermore, in the invention, it is preferable that the magnet is provided so as to be movable along a direction in which an axis of rotation of the toner replenishing container extends.

According to the invention, the magnet is provided so as to be movable along a direction in which an axis of rotation of the toner replenishing container extends. Accordingly, it is possible to scrape toner adhered to the inner wall surface of the toner replenishing container over the whole inner wall surface with one magnetic body, without disposing a plurality of magnets in the direction in which the axis of rotation of the toner replenishing container extends or forming the magnet itself longitudinally.

Furthermore, in the invention, it is preferable that the magnetic body is formed into a rectangular parallelepiped shape.

According to the invention, the magnetic body is formed into a rectangular parallelepiped shape. Accordingly, the magnetic body has right-angled edges on all surfaces, thus, even when the magnetic body is rotated in the toner replenishing container, it is possible to always scrape the inner wall surface of the toner replenishing container with the right-angled edges, resulting that it is possible to obtain the scraping effect stably.

Furthermore, in the invention, it is preferable that the magnetic body is made of ferrite.

According to the invention, the magnetic body is made of ferrite. Ferrite is a magnetic body which is light with high saturation magnetization. Accordingly, even when the magnetic body in the state of being released from the magnetic force of the magnet is mixed in toner by the rotation of the toner replenishing container to be stirred and the magnetic body is collided with toner and the toner replenishing container, it is possible to reduce an impact force thereof and further to prevent the toner replenishing container and the like from being damaged.

Furthermore, in the invention, it is preferable that the magnetic body has a surface covered with resin.

According to the invention, the magnetic body has a surface covered with resin. Accordingly, even when the magnetic body in the state of being released from the magnetic force of the magnet is mixed in toner by the rotation of the toner replenishing container to be stirred and the magnetic body is collided with toner and the toner replenishing container, it is possible to reduce an impact force thereof and further to prevent the toner replenishing container from being damaged.

Furthermore, in the invention, it is preferable that the magnetic body has a hollow structure.

According to the invention, the magnetic body has a hollow structure. Thereby, since an apparent specific gravity of the magnetic body becomes small, it is possible to prevent the magnetic body mixed in toner within the toner replenishing container from being sunk into toner. Accordingly, the magnetic body moves easily together with toner, and when there remain a large quantity of toner in the toner replenishing container, it is possible to prevent the frictional resistance between the magnetic body and toner from being increased. As a result, it is possible to prevent a drive torque for rotating the toner replenishing container from being increased. In addition, when the quantity of residual toner remaining in the toner replenishing container becomes small, the magnetic body is restrained by the magnetic force of the magnet so that the toner adhered to the inner wall surface of the toner containing section is capable of being scraped.

Furthermore, in the invention, it is preferable that the magnetic body has a specific gravity of not less than 0.2 and not more than 0.3.

According to the invention, the magnetic body has a specific gravity of not less than 0.2 and not more than 0.3. In this way, when the magnetic body having smaller specific gravity than toner is mixed in toner within the toner replenishing container, a buoyant force is generated in toner. Accordingly, the magnetic body easily moves with toner, and when there remain a large quantity of toner in the toner replenishing container, it is possible to prevent the frictional resistance between the magnetic body and toner from being increased. As a result, it is possible to prevent a drive torque for rotating the toner replenishing container from being increased. In addition, when the quantity of residual toner remaining in the toner replenishing container becomes small, the magnetic body is restrained by the magnetic force of the magnet so that toner adhered to the inner wall surface of the toner replenishing container is capable of being scraped.

The invention provides an image forming apparatus, comprising:

a photoreceptor on a surface of which an electrostatic image is to be formed;

a charging section for charging the surface of the photoreceptor;

an exposure section for irradiating the surface of the photoreceptor in a charged state with signal light based on image information to form the electrostatic image;

a developing section for developing the electrostatic image on the surface of the photoreceptor to form a toner image;

the above-described toner replenishing apparatus for replenishing toner to the developing section;

a transfer section for transferring the toner image to a recording medium; and a fixing section for fixing the toner image transferred to the recording medium.

According to the invention, an image forming apparatus includes the toner replenishing apparatus capable of preventing a drive torque for rotating the toner replenishing container from being increased, when there remain a large quantity of toner in the toner replenishing container, and capable of efficiently scraping toner adhered to the inner wall surface of the toner replenishing container, when the quantity of residual toner remaining in the toner replenishing container becomes small. As a result, the image forming apparatus is capable of forming an image on a recording medium in a state where toner is capable of being replenished efficiently to the developing section for developing with toner an electrostatic image on the surface of the photoreceptor.

BRIEF DESCRIPTION OF DRAWINGS

Other and further objects, features, and advantages of the invention will be more explicit from the following detailed description taken with reference to the drawings wherein.

DETAILED DESCRIPTION

Figure 1:
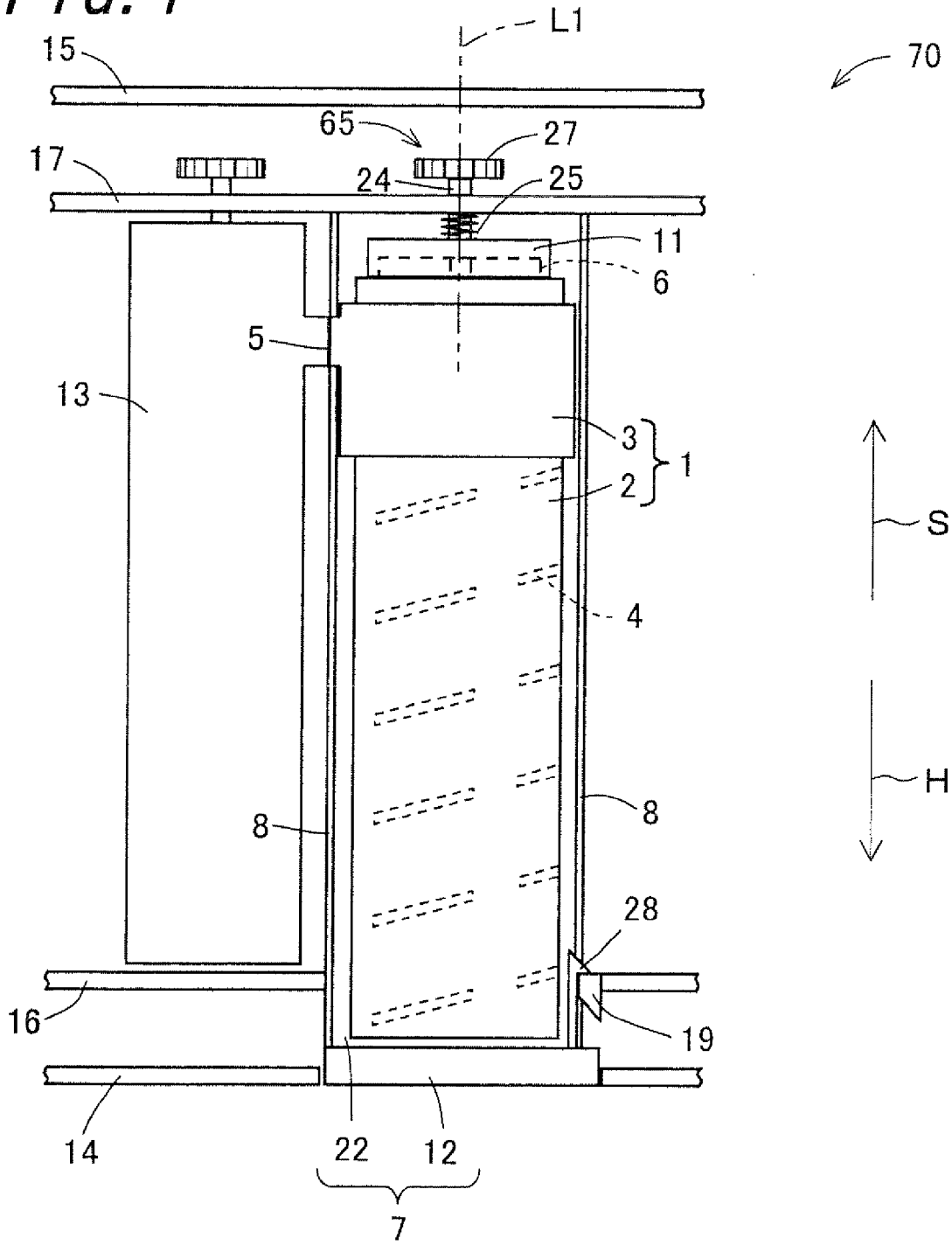
FIG. 1 is a view showing the structure of a toner replenishing apparatus according to an embodiment of the invention.

Now referring to the drawings, preferred embodiments of the invention are described below.

Figure 2:
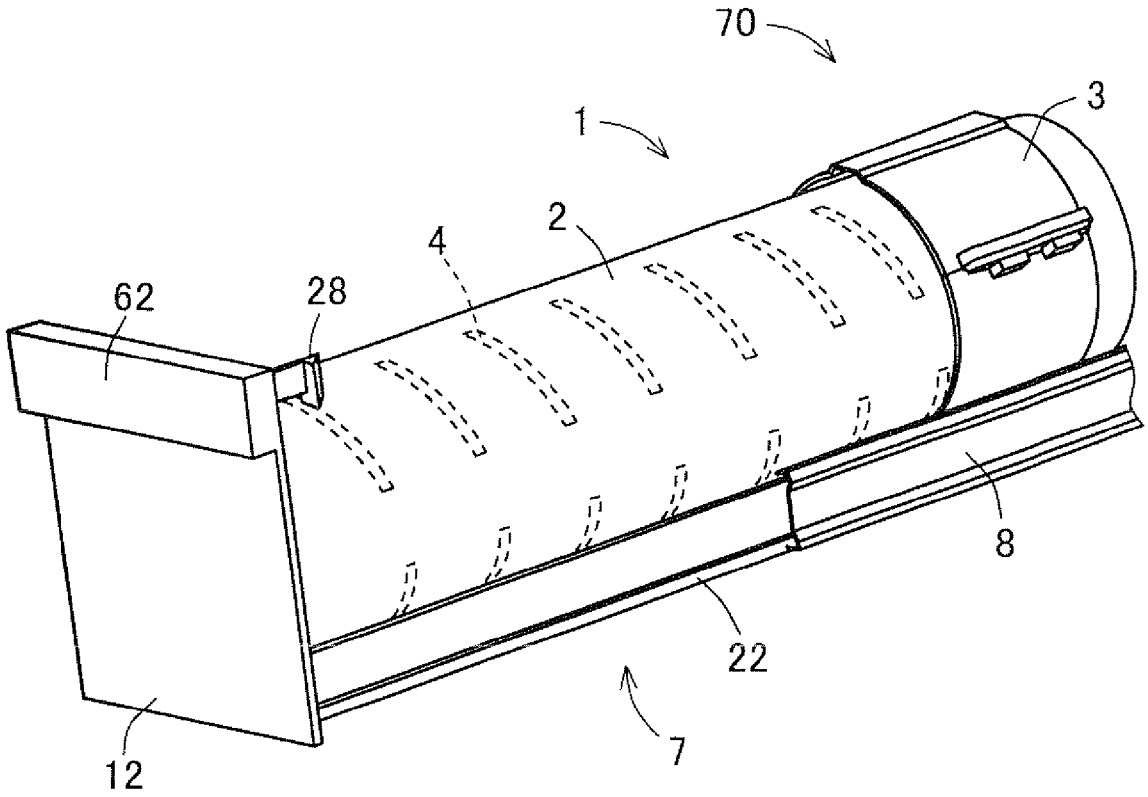
FIG. 2 is a perspective view showing the structure of the toner replenishing apparatus.
Figure 3:
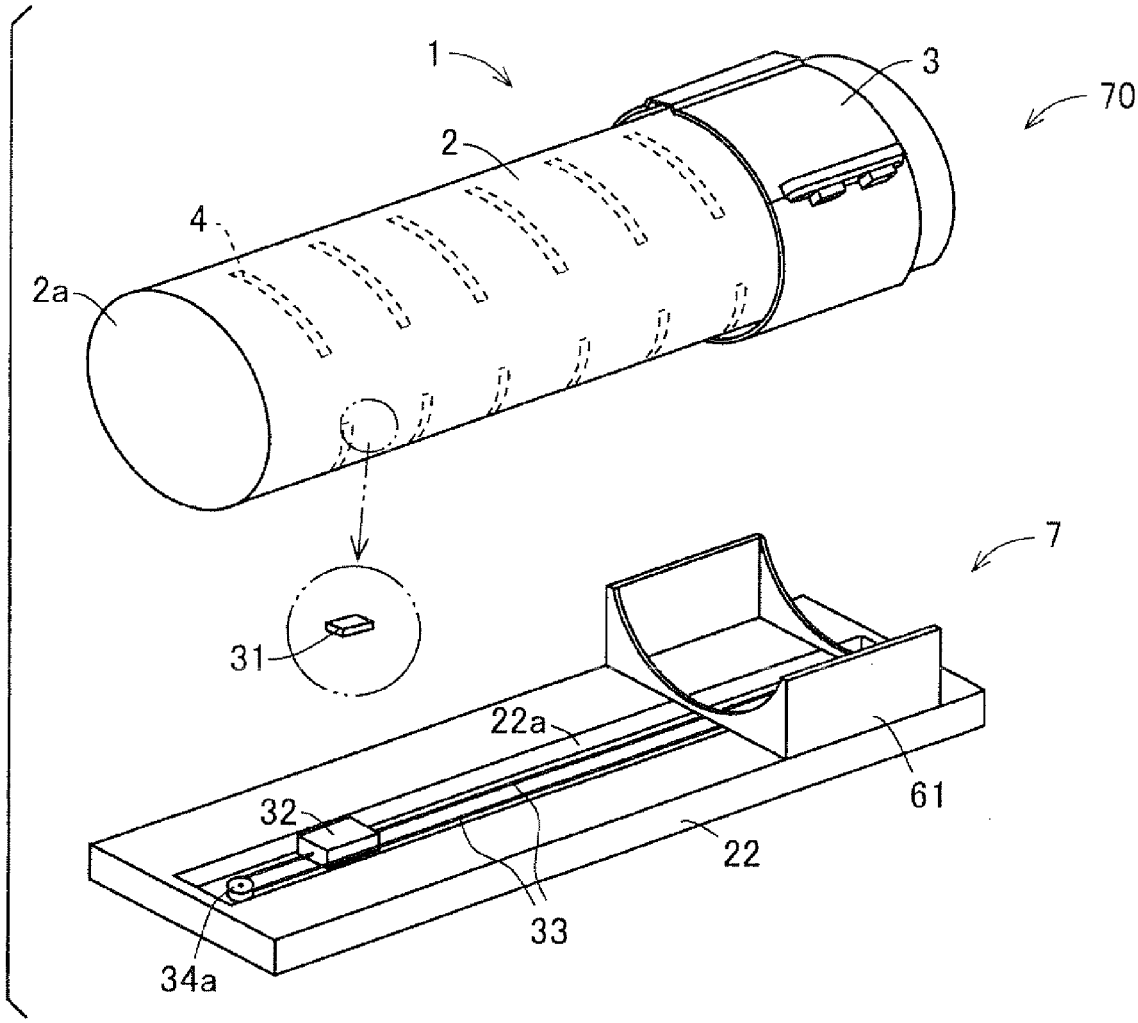
FIG. 3 is an exploded perspective view showing the structure of the toner replenishing apparatus.
Figure 4:
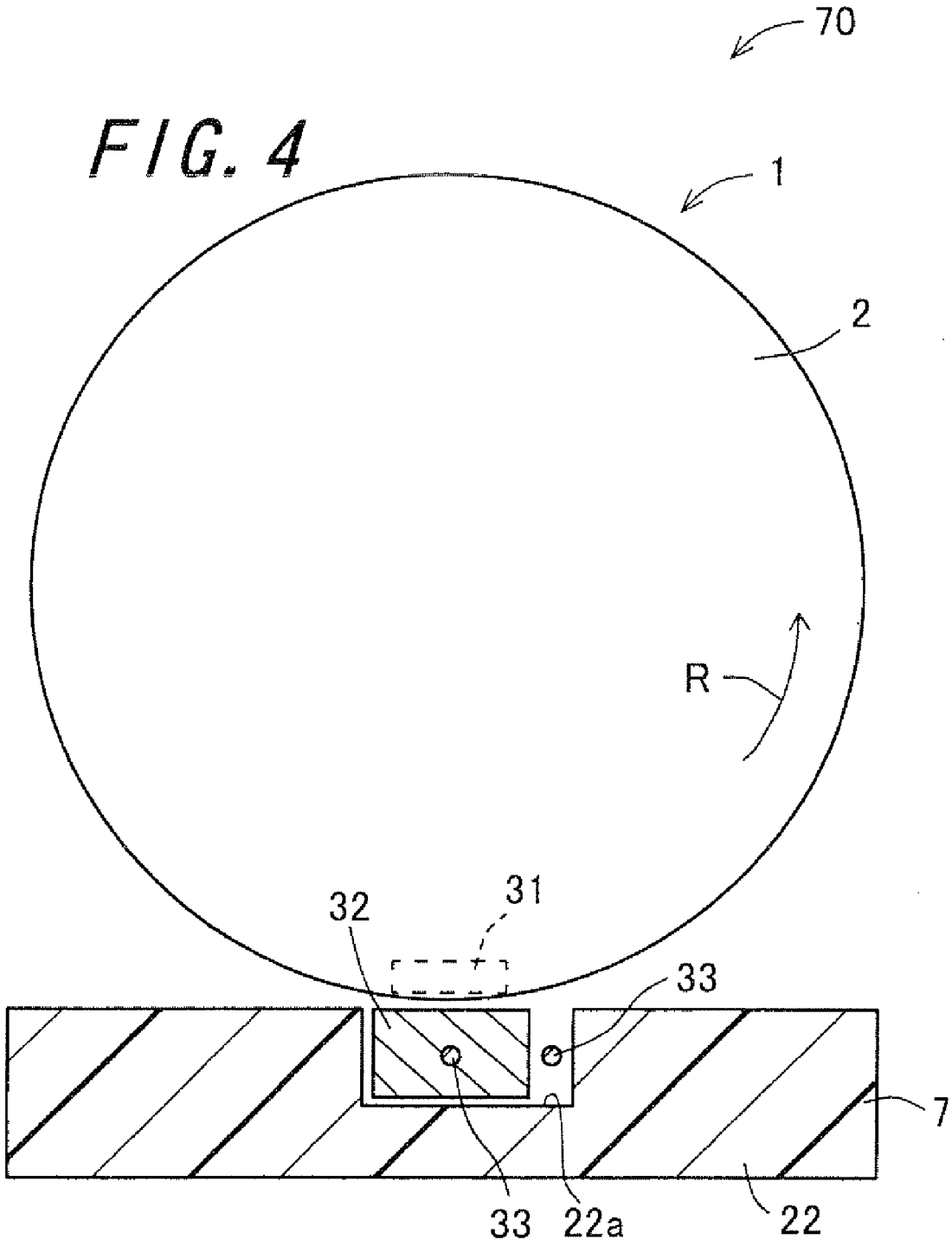
FIG. 4 is a front view showing the structure of the toner replenishing apparatus.
Figure 5:
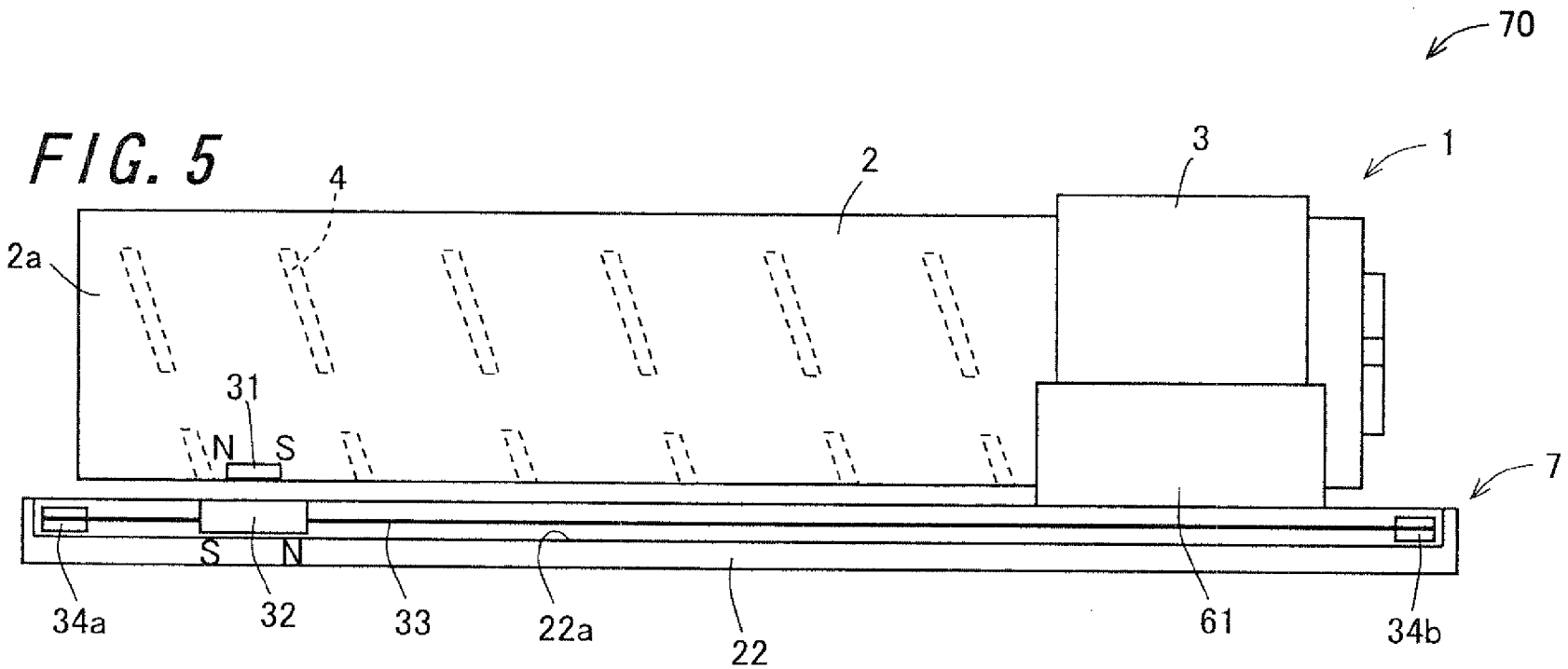
FIG. 5 is a side view showing the structure of the toner replenishing apparatus.

FIG. 1 is a view showing the structure of a toner replenishing apparatus 70 according to an embodiment of the invention. FIG. 2 is a perspective view showing the structure of the toner replenishing apparatus 70. FIG. 3 is an exploded perspective view showing the structure of the toner replenishing apparatus 70. FIG. 4 is a front view showing the structure of the toner replenishing apparatus 70. In addition, FIG. 5 is a side view showing the structure of the toner replenishing apparatus 70. The toner replenishing apparatus 70 is an apparatus for replenishing toner to a developing section 47 provided in an image forming apparatus 100 described below. The toner replenishing apparatus 70 is disposed adjacent to the developing section 47 in the image forming apparatus 100 described below. In addition, the toner replenishing apparatus 70 includes a toner replenishing container 1, a container holding member 7, and a toner hopper 13.

The toner replenishing container 1 has a toner containing section 2 and a supporting member 3. The toner containing section 2 is formed into a cylindrical shape and contains toner therein. In addition, the toner containing section 2 is rotated around an axis L1 of a rotation shaft 24 by a driving force transmission mechanism 65 described below, and is constituted so as to replenish toner contained therein to the toner hopper 13 described below by rotation of its own.

Further, the toner containing section 2 has a through hole 5 and a container-side coupling section 6, and is formed with toner guide projections 4 at an inner wall thereof. The through hole 5 is an opening formed on a side wall of the toner containing section 2, and toner contained in the toner containing section 2 is replenished through the through hole 5 to the toner hopper 13 by rotation of the toner containing section 2. The container-side coupling section 6 is a portion that receives a rotary driving force transmitted from a main body of the image forming apparatus 100 through a main body-side coupling section 11 in the driving force transmission mechanism 65 described below. The toner guide projections 4 are formed spirally corresponding to a rotational direction of the toner containing section 2 at a cylindrical inner peripheral surface of the toner containing section 2. The toner guide projections 4 guide and transport toner toward the through hole 5 when the toner containing section 2 is rotated around the axis L1.

The supporting member 3 supports the toner containing section 2 rotatably around the axis L1, and supports a part of an outer peripheral surface of the toner containing section 2 so as to cover over the whole circumferences.

The toner hopper 13 is a container for reserving toner replenished from the toner replenishing container 1 through the through hole 5, and the toner is supplied from the toner hopper 13 to the developing section 47 in the image forming apparatus 100.

Figure 6:
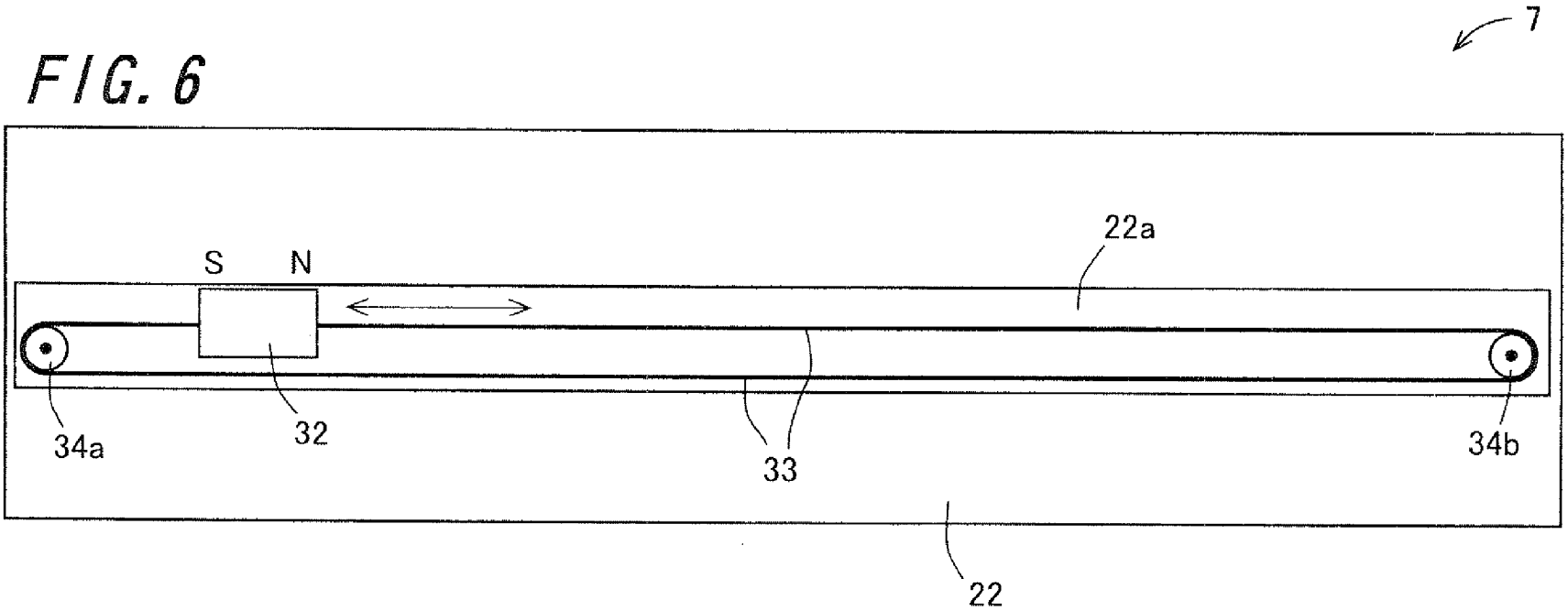
FIG. 6 is a top view showing the structure of a container holding member.

FIG. 6 is a top view showing the structure of the container holding member 7. The container holding member 7 fixes and holds the toner replenishing container 1 at a specified position in the container holding member 7. The container holding member 7 includes a bottom wall section 22 and a container fixing section 61.

The bottom wall section 22 extends in a direction in which the axis L1 extends, in accordance with the toner replenishing container 1, and constitutes a base part on which the toner replenishing container 1 is disposed. The container fixing section 61 is provided on the bottom wall section 22, and detachably holds the supporting member 3 of the toner replenishing container 1 disposed on the bottom wall section 22 to fix the toner replenishing container 1 so that the toner replenishing container 1 does not move in the direction in which the axis L1 extends.

Here, description will hereinafter be given for a position at which the bottom wall section 22 is disposed in the image forming apparatus 100 described below, that is, a position at which the toner replenishing container 1 mounted to the bottom wall section 22 is disposed. In the image forming apparatus 100, a housing is arranged inside an exterior section covering an outer peripheral of the image forming apparatus 100, and each section such as the developing section 47 is disposed in the housing. The exterior section has, as shown in FIG. 1, a front exterior section 14 and a rear exterior section 15 facing each other. The front exterior section 14 is a part positioned at the front of a user of the image forming apparatus 100. Moreover, the rear exterior section 15 is a part corresponding to a rear side of the image forming apparatus 100 when viewed from a user in the side of the front exterior section 14. In addition, the housing disposed inside the exterior section has a housing front section 16 facing the front exterior section 14 and a housing rear section 17 facing the rear exterior section 15.

The bottom wall section 22 of the container holding member 7 that fixes and holds the toner replenishing container 1 has both ends in the direction in which the axis L1 of the bottom wall section 22 extends, and one end in the side where the container fixing section 61 is provided is connected to the housing rear section 17 and the other end is connected to a front wall section 12 as a part of the front exterior section 14 through the housing front section 16.

Moreover, the front wall section 12 is formed with a handle 62 at a front thereof, and the bottom wall section 22 is further provided with two guide members 8 in the direction in which the axis L1 extends. The guide members 8 can be extended and contracted in the direction in which the axis L1 extends, and when the guide members 8 are extended and contracted, the toner replenishing container 1 fixed to the bottom wall section 22 is allowed to move in the direction in which the axis L1 extends.

When a user in the side of the front exterior section 14 pulls the handle 62 formed on the front wall section 12 in a pull-out direction H, the toner replenishing container 1 fixed to the bottom wall section 22 of the container holding member 7 is able to be pulled out to a position outward of the front exterior section 14. Accordingly, it is possible to easily pull out the used toner replenishing container 1. In addition, when the user attaches the new toner replenishing container 1 to the container holding member 7 and pushes the handle 62 in a direction S from the front exterior section 14 toward the rear exterior section 15, to thereby return to an original position.

Further, the front wall section 12 connected to the bottom wall section 22 of the container holding member 7 is formed with a hook member 28, and the housing front section 16 is formed with an engagement member 19. The hook member 28 and the engagement member 19 are provided so that, in a state where the toner replenishing container 1 is fixed to the container holding member 7 and the container holding member 7 is fully stored, the hook member 28 is engaged with the engagement member 19. Thereby, it is possible to reliably maintain the stored state of the toner replenishing container 1 fixed to the container holding member 7. Note that, the arrangement positions of the hook member 28 and the engagement member 19 are not limited to the above, and the hook member 28 may be provided in the housing front section 16 and the engagement member 19 may be provided in the front wall section 12.

Further, the driving force transmission mechanism 65 is provided at a position facing the toner replenishing container 1 in the housing rear section 17. The driving force transmission mechanism 65 transmits a rotary driving force to the toner containing section 2, and includes the main body-side coupling section 11, the rotation shaft 24, a pressure spring 25, and a gear 27. The rotation shaft 24 serves as a shaft for rotation of the toner containing section 2, and penetrates the housing rear section 17. A bearing section (not shown) is provided at a position of the housing rear section 17 in the rotation shaft 24 to allow the rotation shaft 24 to rotate freely.

The main body-side coupling section 11 is formed into a substantially disc shape, and is fixed to the rotation shaft 24 so as to be capable of being rotated around the axis L1 integrally with the rotation shaft 24. Formed on a surface in contact with the toner containing section 2 in the main body-side coupling section 11 is a cross-like fitting recessed section into which the container-side coupling section 6 of the toner containing section 2 can be fitted. The pressure spring 25 made of a coil spring is disposed between the housing rear section 17 and the main body-side coupling section 11, and applies a spring force in a direction where the main body-side coupling section 11 is separated from the housing rear section 17, without inhibiting the rotation of the rotation shaft 24 and the main body-side coupling section 11. The gear 27 is fixed to an end at an opposite side to the main body-side coupling section 11 in the rotation shaft 24. A driving force for causing the toner containing section 2 to rotate is transferred from a driving source of the image forming apparatus 100 to the gear 27.

Next, description will be given for a magnetic body 31 and a magnet 32 as characteristic structure in the toner replenishing apparatus 70. The magnetic body 31 is movably provided in the toner containing section 2. In addition, the magnet 32 is provided on the bottom wall section 22 of the container holding member 7 closely to the outer peripheral surface of the toner replenishing container 1 and attracts the magnetic body 31 with a magnetic force.

As shown in FIG. 6, the magnet 32 is coupled through a wire 33 to the bottom wall section 22, and is disposed inside a recessed rail 22*a* provided on the bottom wall section 22 so as to be movable along the direction in which the axis L1 of the toner containing section 2 extends. The wire 33 is looped between pulleys 34*a* and 34*b*, and when the pulleys 34*a* and 34*b* are rotated with a driving section (not shown), the magnet 32 is reciprocated along the recessed rail 22*a*.

When the toner containing section 2 is rotated around the axis L1, a force (magnetic force) that the magnet 32 to hold the magnetic body 31 at a nearest position is exerted, resulting that there arises a speed difference between the magnetic body 31 and the inner wall surface of the toner containing section 2, and the magnetic body 31 rubs against the inner wall surface of the toner containing section 2. This rubbing force enables to scrape toner adhered to the inner wall surface of the toner containing section 2, thus making it possible to reduce the toner adhered to the inner wall surface of the toner containing section 2 to thereby reduce the quantity of residual toner that remains unfed from the toner containing section 2. Furthermore, when there remain a large quantity of toner in the toner containing section 2, a force of attraction between the magnetic body 31 mixed in the toner and the magnet 32 is reduced, thus making it possible to prevent the frictional resistance between the magnetic body 31 and the toner in rotating the toner containing section 2 from being increased. As a result, it is possible to prevent a drive torque for rotating the toner containing section 2 from being increased and to prevent a driving component of the toner containing section 2 from wearing.

Although the position at which the magnet 32 is disposed is not particularly limited as far as it is a position close to the outer peripheral surface of the toner containing section 2, in the embodiment, the magnet 32 is disposed closely to the outer peripheral surface extending by including a lowermost point in a rotary circumferential surface of the outer peripheral surface of the toner containing section 2. Thereby, when the quantity of residual toner remaining in the toner containing section 2 becomes small, the magnetic body 31 moves toward a direction of the lowermost point of the toner containing section 2 with the weight of the magnetic body 31 to be reliably attracted to the magnet 32. Accordingly, when the quantity of residual toner remaining in the toner containing section 2 becomes small, the magnetic body 31 attracted by the magnet 32 is able to scrape the toner adhered to the inner wall surface of the toner containing section 2 reliably.

Moreover, by providing the magnet 32 so as to be movable along the direction in which the axis L1 of the toner containing section 2 extends, it is possible to scrape the toner adhered to the inner wall surface of the toner containing section 2 over the whole inner wall surface with one magnetic body 31, without disposing a plurality of magnets 32 in the direction in which the axis L1 of the toner containing section 2 extends or forming the magnet 32 itself longitudinally. Further, since the magnetic body 31 attracted to the magnet 32 moves in the toner containing section 2 in synchronization with movement of the magnet 32, the effect that the magnetic body 31 transports the toner is obtained. Accordingly, even when each size of the toner guide projections 4 provided in the toner containing section 2 is reduced or the number thereof is reduced, it is possible to keep the effect that the toner guide projections 4 guide and transport toner toward the through hole 5.

In addition, when it is possible to reduce the size of the toner guide projections 4 and the number thereof, the magnet 32 can be moved smoothly in the toner containing section 2 and the toner adhered to the inner wall surface of the toner containing section 2 can be scraped more efficiently. Further, the toner containing section 2 in which the size of the toner guide projections 4 and the number thereof can be reduced is capable of being manufactured in a short molding time and with reduced manufacturing cost, further, strength of the toner containing section 2 itself can be increased.

The shape of the magnetic body 31 is not particularly limited, but in the embodiment, the magnetic body 31 is formed into a rectangular parallelepiped shape. Thereby, the magnetic body 31 has right-angled edges on all surfaces, thus, even when the magnetic body 31 is rotated in the toner containing section 2, it is possible to always scrape the inner wall surface of the toner containing section 2 with the right-angled edges, resulting that it is possible to obtain the scraping effect stably.

Further, the size of the magnetic body 31 is not particularly limited, but the length of the magnetic body 31 in the longitudinal direction is preferably set to be 5 to 30% relative to an inner diameter of the toner containing section 2. When the length of the magnetic body 31 in the longitudinal direction is set to be smaller than 5% relative to the inner diameter of the toner containing section 2, a force for scraping toner adhered to the inner wall surface of the toner containing section 2 by the magnetic body 31 becomes too small, and when exceeding 30%, the size of the magnetic body 31 is so large that a frequency of contacting the inner wall surface of the toner containing section 2 is reduced, thus reducing the effect of scraping toner.

Further, in the embodiment, the magnetic body 31 is made of ferrite covered with resin. Ferrite is a light magnetic body with high saturation magnetization. Accordingly, even when the magnetic body 31 in the state of being released from the magnetic force of the magnet 32 is mixed in toner by the rotation of the toner containing section 2 to be stirred and the magnetic body 31 is collided with the toner and the inner wall surface of the toner containing section 2, it is possible to reduce an impact force thereof and further to prevent the inner wall surface of the toner containing section 2 from being damaged. In addition, since the magnetic body 31 has a surface covered with resin, even when the magnetic body 31 in the state of being released from the magnetic force of the magnet is mixed in toner by the rotation of the toner replenishing containing section 2 to be stirred and the magnetic body 31 is collided with toner and the inner wall surface of the toner replenishing containing section 2, it is possible to reduce an impact force thereof and further to prevent the inner wall surface of the toner replenishing containing section 2 and the like from being damaged.

Further, the magnetic body 31 preferably has a hollow structure. Thereby, since an apparent specific gravity of the magnetic body 31 becomes small, it is possible to prevent the magnetic body 31 mixed in the toner within the toner containing section 2 from being sunk into the toner. Accordingly, the magnetic body 31 moves easily together with the toner, and when there remain a large quantity of toner in the toner containing section 2, it is possible to prevent the frictional resistance between the magnetic body 31 and the toner from being increased. As a result, it is possible to prevent a drive torque for rotating the toner containing section 2 from being increased. In addition, when the quantity of residual toner remaining in the toner containing section 2 becomes small, the magnetic body 31 is restrained by the magnetic force of the magnet 32 so that the toner adhered to the inner wall surface of the toner containing section 2 can be scraped.

Further, the magnetic body 31 preferably has a specific gravity of not less than 0.2 and not more than 0.3. In this way, when the magnetic body 31 having smaller specific gravity than the toner is mixed in the toner within the toner containing section 2, a buoyant force is generated in the toner. Accordingly, the magnetic body 31 easily moves together with the toner, and when there remain a large quantity of toner in the toner containing section 2, it is possible to prevent the frictional resistance between the magnetic body 31 and the toner from being increased. As a result, it is possible to prevent a drive torque for rotating the toner containing section 2 from being increased. In addition, when the quantity of residual toner remaining in the toner containing section 2 becomes small, the magnetic body 31 is restrained by the magnetic force of the magnet 32 so that the toner adhered to the inner wall surface of the toner containing section 2 can be scraped.

Next, description will be given for the timing when the toner replenishing apparatus 70 replenishes toner to the developing section 47 described below, and a moving timing and a moving amount of the magnet 32. In the toner replenishing apparatus 70, depending on the toner consumption in the developing section 47, the toner containing section 2 is rotated around the axis L1 to replenish toner contained therein through the toner hopper 13 to the developing section 47. Further, when the magnet 32 is moved, the magnetic body 31 moves in the toner containing section 2 to scrape the toner adhered to the inner wall surface of the toner containing section 2.

In the embodiment, when the toner containing section 2 is rotated once, 0.2% of toner relative to the entire inner volume of the toner containing section 2 is replenished to the developing section 47. When the quantity of toner contained in the toner containing section 2 reaches 10% relative to the entire inner volume of the toner containing section 2, the magnet 32 is started to move to start scraping of the toner adhered to the inner wall surface of the toner containing section 2 by the magnetic body 31. At this time, the moving amount of the magnet 32 is set so that, in response to one rotation of the toner containing section 2, the magnet 32 moves by the length corresponding to 2% relative to the total length of the toner containing section 2 in the longitudinal direction (direction in which the axis L1 extends). Note that, the magnet 32 moves when the toner containing section 2 continues to rotate.

As described above, in the toner replenishing apparatus 70, by controlling the rotational timing of the toner containing section 2 and the moving timing and the moving amount of the magnet 32, it is possible to replenish the toner contained in the toner containing section 2 to the developing section 47 while scraping the toner adhered to the inner wall surface of the toner containing section 2.

Note that, the control for the rotational timing of the toner containing section 2 and the moving timing and the moving amount of the magnet 32 is not limited to the above, but may be performed as follows.

For example, the control is performed so that the timing to start moving of the magnet 32 is made earlier as well as the moving amount of the magnet 32 is made small. Specifically, when the quantity of toner contained in the toner containing section 2 reaches 20% relative to the entire inner volume of the toner containing section 2, the magnet 32 is started to move to start scraping of the toner adhered to the inner wall surface of the toner containing section 2 by the magnetic body 31. At this time, the moving amount of the magnet 32 is set so that, in response to one rotation of the toner containing section 2, the magnet 32 moves by the length corresponding to 1% relative to the total length of the toner containing section 2 in the longitudinal direction.

Further, the movement of the magnet 32 may be controlled so as to repeat moving and stopping without continuously moving the magnet 32. Specifically, when the quantity of toner contained in the toner containing section 2 reaches 10% relative to the entire inner volume of the toner containing section 2, the magnet 32 is started to move to start scraping of the toner adhered to the inner wall surface of the toner containing section 2 by the magnetic body 31. Then, in response to one rotation of the toner containing section 2, the magnet 32 moves by the length corresponding to 4% relative to the total length of the toner containing section 2 in the longitudinal direction. During one rotation of the toner containing section 2 next time, the movement of the magnet 32 is stopped. In this way, the movement of the magnet 32 is controlled so as to repeat moving and stopping.

Moreover, the magnet 32 may be controlled so as to reciprocate. Specifically, when the quantity of toner contained in the toner containing section 2 reaches 20% relative to the entire inner volume of the toner containing section 2, the magnet 32 is started to move to start scraping of the toner adhered to the inner wall surface of the toner containing section 2 by the magnetic body 31. Then, in response to one rotation of the toner containing section 2, the magnet 32 moves by the length corresponding to 5% relative to the total length of the toner containing section 2 in the longitudinal direction. When the magnet 32 reaches an end in the toner containing section 2, the magnet 32 is caused to pass through a gap between the toner guide projections 4 to be returned to an original position while the rotation of the toner containing section 2 is stopped. In this way, the movement of the magnet 32 is controlled so that the magnet 32 is reciprocated.

Figure 7:
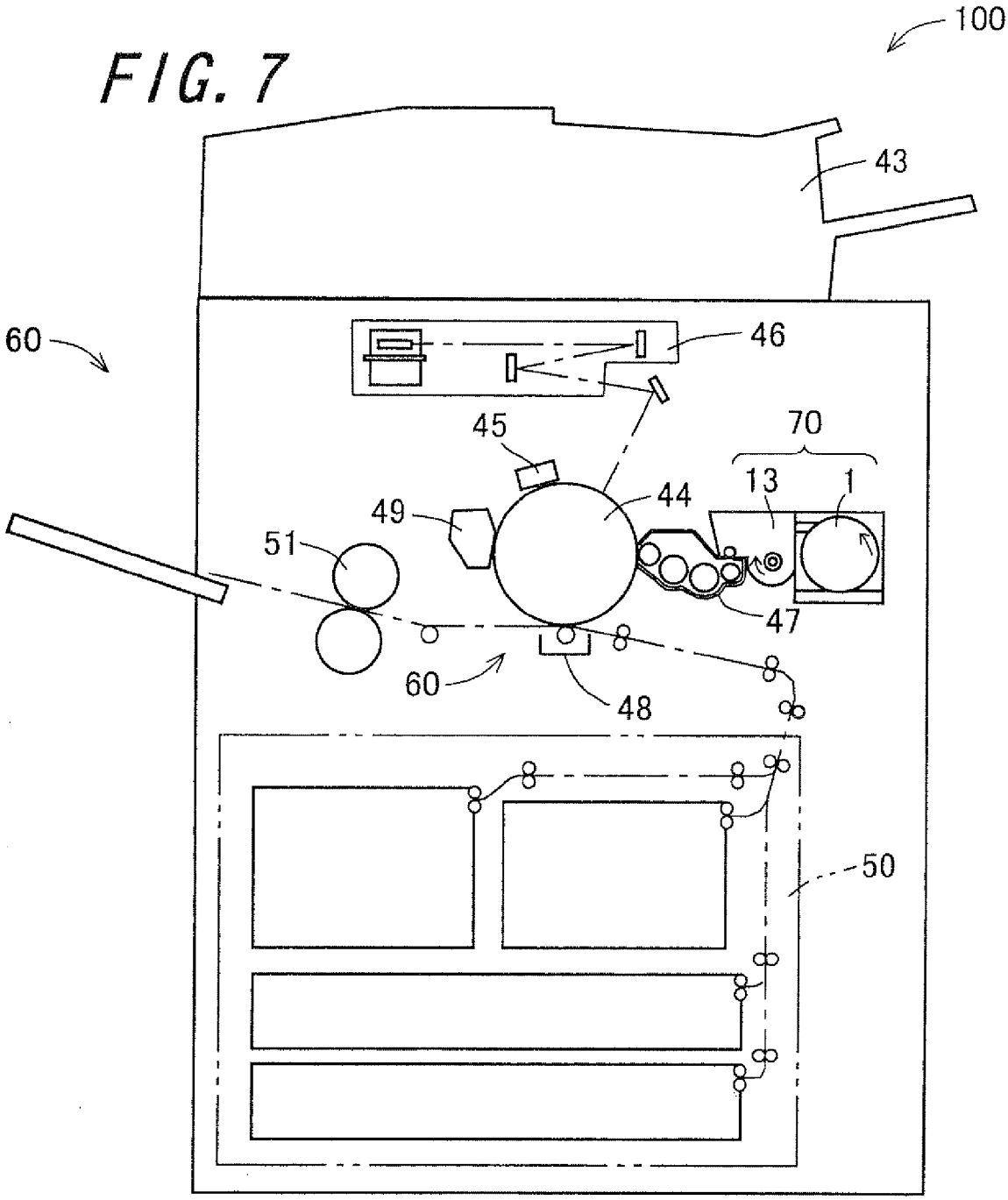
FIG. 7 is a view showing the structure of the image forming apparatus according to an embodiment of the invention.

FIG. 7 is a view showing the structure of the image forming apparatus 100 according to an embodiment of the invention. The image forming apparatus 100 is an apparatus for forming an image on a surface of a recording medium such as recording paper to obtain a printed matter. The image forming apparatus 100 includes an electrophotographic process section 60 and a sheet supply section 50. The electrophotographic process section 60 includes a photoreceptor drum 44, a charging section 45, an exposure section 46, the developing section 47, a transfer section 48, a cleaning section 49, and a fixing section 51, and forms an image on a recording medium supplied from the sheet supply section 50.

The photoreceptor drum 44 is supported so as to be rotatable around an axis thereof by a driving section (not shown) and includes a cylindrical-shaped or columnar- shaped conductive substrate (not shown) and a photosensitive layer formed on the surface of the conductive substrate. As the photoreceptor drum 44, a photoreceptor drum commonly used in this field may be used, and an example thereof includes one containing an aluminum pipe as the conductive substrate and an organic photosensitive layer formed on the surface of the aluminum pipe. The organic photosensitive layer is composed by laminating a charge generating layer containing a charge generating substance and a charge transporting layer containing a charge transporting substance. The organic photosensitive layer may include the charge generating substance and the charge transporting substance in a layer.

The charging section 45 charges the surface of the photoreceptor drum 44 with a predetermined polarity and at a predetermined potential. In the embodiment, a charging roller is used as the charging section 45, but without limitation thereto, for example, it is possible to use a brush-type charging device, a charger-type charging device, a corona charging device such as a scorotron charger, and the like. The exposure section 46 irradiates the surface of the photoreceptor drum 44 in a charged state with signal light corresponding to image information of a document read by a scanner 43, and forms an electrostatic image corresponding to the image information on the surface of the photoreceptor drum 44. For the exposure section 46, a laser beam scanner and the like are used.

The developing section 47 supplies toner to the electrostatic image on the surface of the photoreceptor drum 44 and develops the electrostatic image to form a toner image. At this time, depending on the toner consumption in the developing section 47, toner is replenished from the toner hopper 13 of the toner replenishing apparatus 70. The transfer section 48 is brought into pressure-contact with the surface of the photoreceptor drum 44, and, in synchronization with reaching of the toner image on the photoreceptor drum 44 to the pressure-contact portion of the photoreceptor drum 44 and the transfer section 48, transfers the toner image on the surface of the photoreceptor drum 44 on the recording medium conveyed from the sheet supply section 50 described below to the pressure-contact portion of the photoreceptor drum 44 and the transfer section 48, by applying transfer bias voltage and pressure to the toner image, which transfer bias voltage having an opposite polarity to a polarity of toner constituting the toner image. For the transfer section 48, for example, a transfer roller is used.

The fixing section 51 fixes the toner image carried on the recording medium by the transfer section 48 to the recording medium with heat and pressure. The cleaning section 49 is provided so as to be brought into contact with the surface of the photoreceptor drum 44, and removes toner, paper powder and the like remaining on the surface of the photoreceptor drum 44 after the toner image is transferred to the recording medium to clean the surface of the photoreceptor drum 44.

According to the electrophotographic process section 60, after charging the surface of the photoreceptor drum 44 that rotates around the axis thereof by the charging section 45, signal light corresponding to image information is irradiated by the exposure section 46 to from an electrostatic image. Then, the developing section 47 supplies toner replenished from the toner replenishing apparatus 70 to the electrostatic image to obtain a toner image, and the toner image is transferred to a recording medium by the transfer section 48. The toner image is fixed to the recording medium by applying heat and pressure by means of the fixing section 51. The recording medium having the image formed thereon in this way is fed to outside the image forming apparatus 100. Meanwhile, the surface of the photoreceptor drum 44 after transfer of the toner image is cleaned by the cleaning section 49. The series of processes is repeated to form an image.

The sheet supply section 50 includes a sheet cassette for storing a recording medium and a sheet feed path serving as a passage in which a recording medium is conveyed. The recording medium stored in the sheet cassette is conveyed through the sheet feed path to the contact portion of the photoreceptor drum 44 and the transfer section 48 in the electrophotographic process section 60 and conveyed to the fixing section 51.

The image forming apparatus 100 includes the toner replenishing apparatus 70 capable of preventing a drive torque for rotating the toner containing section 2 from being increased, when there remain a large quantity of toner in the toner containing section 2 of the toner replenishing container 1, and capable of efficiently scraping toner adhered to the inner wall surface of the toner containing section 2, when the quantity of residual toner remaining in the toner containing section 2 becomes small. As a result, the image forming apparatus 100 can form an image on a recording medium in a state where toner can be replenished efficiently to the developing section 47 for developing with toner an electrostatic image on the surface of the photoreceptor drum 44.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A toner replenishing apparatus for replenishing toner to a developing section which develops with toner an electrostatic image on a surface of a photoreceptor drum, comprising:

a toner replenishing container formed into a cylindrical shape, for replenishing toner stored therein, to the developing section by rotation of the toner replenishing container;

a magnetic body movably provided in the toner replenishing container; and a magnet disposed closely to an outer peripheral surface of the toner replenishing container, and attracting the magnetic body with a magnetic force, wherein the magnet is provided so as to be movable along a direction in which an axis of rotation of the toner replenishing container extends.

2. The toner replenishing apparatus of claim 1, wherein the magnet is disposed closely to the outer peripheral surface extending by including a lowermost point in a rotary circumferential surface of the outer peripheral surface of the toner replenishing container.

3. The toner replenishing apparatus of claim 1, wherein the magnetic body is formed into a rectangular parallelepiped shape.

4. The toner replenishing apparatus of claim 1, wherein the magnetic body is made of ferrite.

5. The toner replenishing apparatus of claim 1, wherein the magnetic body has a surface covered with resin.

6. The toner replenishing apparatus of claim 1, wherein the magnetic body has a hollow structure.

7. The toner replenishing apparatus of claim 1, wherein the magnetic body has a specific gravity of not less than 0.2 and not more than 0.3.

8. An image forming apparatus, comprising:

a photoreceptor on a surface of which an electrostatic image is to be formed;

a charging section for charging the surface of the photoreceptor;

an exposure section for irradiating the surface of the photoreceptor in a charged state with signal light based on image information to form the electrostatic image;

a developing section for developing the electrostatic image on the surface of the photoreceptor to form a toner image;

the toner replenishing apparatus of claim 1, for replenishing toner to the developing section;

a transfer section for transferring the toner image to a recording medium; and a fixing section for fixing the toner image transferred to the recording medium.

9. A toner replenishing apparatus for replenishing toner to a developing section which develops with toner an electrostatic image on a surface of a photoreceptor drum, comprising:

a toner replenishing container formed into a cylindrical shape, for replenishing toner stored therein, to the developing section by rotation of the toner replenishing container;

a magnetic body movably provided in the toner replenishing container, wherein the magnetic body is formed into a rectangular parallelepiped shape; and a magnet disposed closely to an outer peripheral surface of the toner replenishing container, and attracting the magnetic body with a magnetic force.

10. A toner replenishing apparatus for replenishing toner to a developing section which develops with toner an electrostatic image on a surface of a photoreceptor drum, comprising:

a toner replenishing container formed into a cylindrical shape, for replenishing toner stored therein, to the developing section by rotation of the toner replenishing container;

a magnetic body movably provided in the toner replenishing container, wherein the magnetic body has a hollow structure; and a magnet disposed closely to an outer peripheral surface of the toner replenishing container, and attracting the magnetic body with a magnetic force.

11. A toner replenishing apparatus for replenishing toner to a developing section which develops with toner an electrostatic image on a surface of a photoreceptor drum, comprising:

a toner replenishing container formed into a cylindrical shape, for replenishing toner stored therein, to the developing section by rotation of the toner replenishing container;

a magnetic body movably provided in the toner replenishing container, wherein the magnetic body has a specific gravity of not less than 0.2 and not more than 0.3; and a magnet disposed closely to an outer peripheral surface of the toner replenishing container, and attracting the magnetic body with a magnetic force.

* * * * *